US007650769B2

(12) United States Patent
Lo

(10) Patent No.: US 7,650,769 B2
(45) Date of Patent: Jan. 26, 2010

(54) LOCK DEVICE

(76) Inventor: Tsung-I Lo, Shijie Village, Yantian Management District, Fenggang Town, Dongguan City, Guang Dong Province (CN)

( * ) Notice: Subject to any disclaimer, the term of this patent is extended or adjusted under 35 U.S.C. 154(b) by 0 days.

(21) Appl. No.: 12/213,812

(22) Filed: Jun. 25, 2008

(65) Prior Publication Data

US 2009/0158794 A1 Jun. 25, 2009

(30) Foreign Application Priority Data

Dec. 24, 2007 (CN) ..... 2007 1 0125465

(51) Int. Cl.
*E05B 27/00* (2006.01)

(52) U.S. Cl. ..... 70/368; 70/371

(58) Field of Classification Search ..... 70/367, 70/368, 370, 371

See application file for complete search history.

(56) References Cited

U.S. PATENT DOCUMENTS 5,979,200 A * 11/1999 Cliff ..... 70/491
6,523,378 B2 * 2/2003 Kuo ..... 70/360
6,644,078 B1 * 11/2003 Hung ..... 70/491

* cited by examiner

*Primary Examiner*—Suzanne D Barrett
(74) *Attorney, Agent, or Firm*—Bacon & Thomas, PLLC

(57) ABSTRACT

A lock device includes a housing with a center through hole and a core that matches the center through hole. There is a center through hole engagement groove in the wall of the center through hole and there is a core engagement groove opposite this center through hole engagement groove. The lock includes a fitting ring and elastic part. The fitting ring and elastic part are between the center through hole engagement groove and the core engagement groove, within the core engagement groove. The advantages of the aforementioned lock are that assembly is convenient and use is not easily affected by assembly.

3 Claims, 4 Drawing Sheets

LOCK DEVICE

BACKGROUND OF THE INVENTION

1. Field of the invention

This invention involves a lock device.

2. Description of the Prior Art

Locks are often used in normal daily life. Most existing locks include a housing, core and stop parts fixed opposite the core that allows the core to rotate within the housing. The stop parts can be a bolt fixed at one end of the core, a C-ring button matching the core or a pin driven through the housing. However, these stop parts can cause inconvenience when the lock is installed or used, some even affect lock use. For example, after a period of use the nut can fall off, C-rings take up a relatively large space and can easily become stuck in the keyhole opening. When pins are driven through the housing, the vibration can affect the alignment of other parts and after use for a period of time they can become detached and fall off.

SUMMARY OF THE INVENTION

For the reasons outlined above it is necessary to have a lock that is easy to assemble and the use of which is not affected by assembly. A kind of lock device, including a housing with a center through hole and a core that matches the center through hole. There is a center through hole engagement groove in the wall of the center through hole in the housing and the core has a core engagement groove opposite this center through hole engagement groove. The lock also includes a fitting ring and elastic part. The fitting ring and elastic part are located between the center through hole engagement groove and the core engagement groove, within the core engagement groove.

The aforementioned lock has a center through hole engagement groove, core engagement groove, fitting ring and elastic part. The elastic effect of the elastic part causes the fitting ring to clip into the key hole engagement groove and core engagement groove, allowing the core to be fixed in the center through hole and able to rotate. When the aforementioned lock is assembled, the core can be easily inserted into the housing by pressing the fitting ring, making assembly relatively convenient. The fitting ring is also clipped in the center through hole engagement groove and core engagement groove, thus it cannot fall out easily after a long period of use and lock use will thus not be affected.

BRIEF DESCRIPTION OF DRAWINGS

This invention is better understood by referring to the accompanying drawings, wherein.

DETAILED DESCRIPTION OF THE PREFERRED EMBODIMENT

Figure 1:
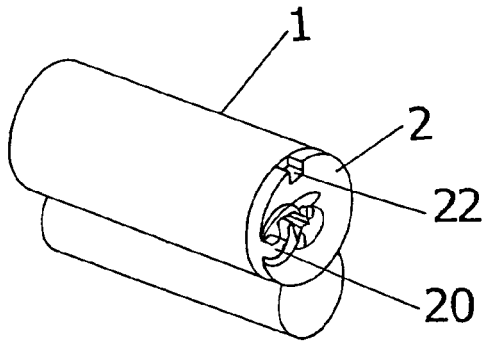
FIG. 1 is a perspective drawing of the lock in the preferred embodiment of the invention.
Figure 2:
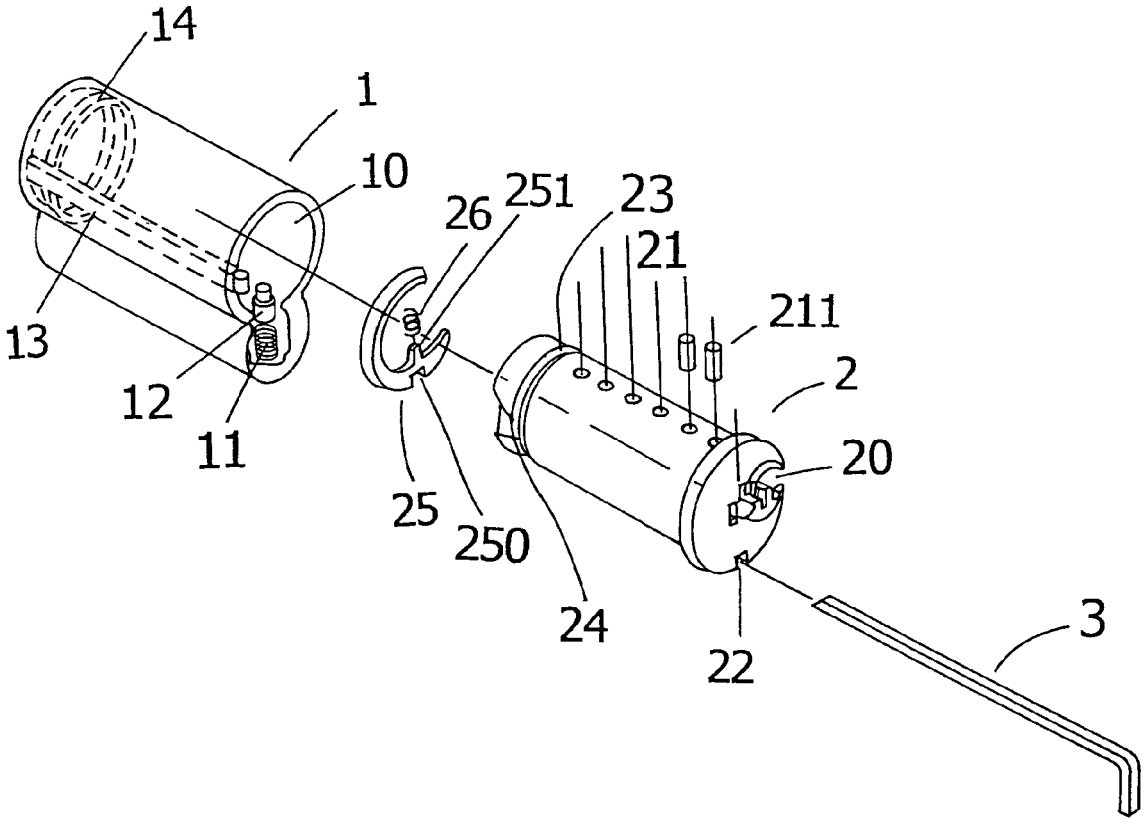
FIG. 2 is an exploded view of the lock in FIG. 1.

As shown in FIGS. 1~8, a preferred embodiment of the present invention includes a housing 1, core 2, first tumbler pin 211, second tumbler pin 12, fitting ring 25, first spring 26, second spring 11 and compression rod 3.

Below, the attached drawings and the preferred embodiment will be used to give a detailed description of the lock in this invention. Please refer to FIGS. 1 and 2, which show the lock that is the preferred embodiment of the invention. It includes a housing 1, core 2, first tumbler pin 211, second tumbler pin 12, fitting ring 25, first spring 26, second spring 11 and compression rod 3.

On housing 1 there is a center through hole 10 that is almost circular pillar shaped. On the inner wall of center through hole 10 there is a rectangular longitudinal groove 13 extending in the same direction as center through hole 10. Near the end of center through hole 10, there is a center through hole engagement groove 14 that intersects the center through hole longitudinal groove 13. Center through hole engagement groove 14 is a curved groove.

Figure 3:
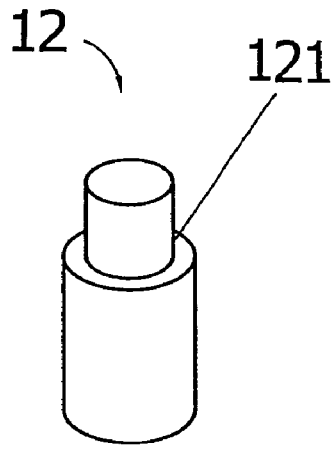
FIG. 3 is an enlarged view of the second tumbler pin in FIG. 2.

Please also look at FIG. 3. The second tumbler pin 12 is step-shaped and has a step member 121. The second tumbler pin 12 and second spring 11 are on the inner wall of housing's 1 center through hole 10. The spring pushes up the second tumbler pin 12, causing a small part of the step member 121 to protrude from the center through hole 10 inner wall.

The shape of core 2 and the housing 1 center through hole 10 match. There is a key hole 20 in the middle of the core 2. On its surface there is a core longitudinal groove 22 and a number of pin holes 21 connected to key hole 20 and the core engagement groove 23. The core longitudinal groove 22 and tumbler pin hole 21 are on opposite sides of the core surface, allowing it to be understood that core longitudinal groove 22 can be in another position apart from tumbler pin hole 21 and key hole 20 on the surface of the core 2. Center through hole engagement groove 14, core engagement groove 23 and core longitudinal groove 22 intersect at the end of core 2. Core engagement groove 23 is also a curved groove. The first tumbler pin 211 is inside tumbler pin hole 21. Also, the core 2 has a sloping face 24 on the surface at the core engagement groove 23 end and the sloping face 24 is a conical sloping face.

The fitting ring 25 is curved and on its outside there is a recess 250 that creates a projection 251 together with the inside of opposite recess 250. The first spring 26 is fitted on the fitting ring projection 251. Fitting ring 25 and first spring 26 are between center through hole engagement groove 14 and core engagement groove 23.

Figure 4:
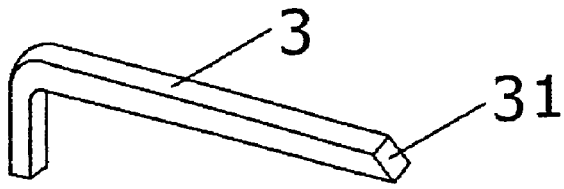
FIG. 4 is a schematic diagram of the lock compression rod in FIG. 1.
Figure 5:
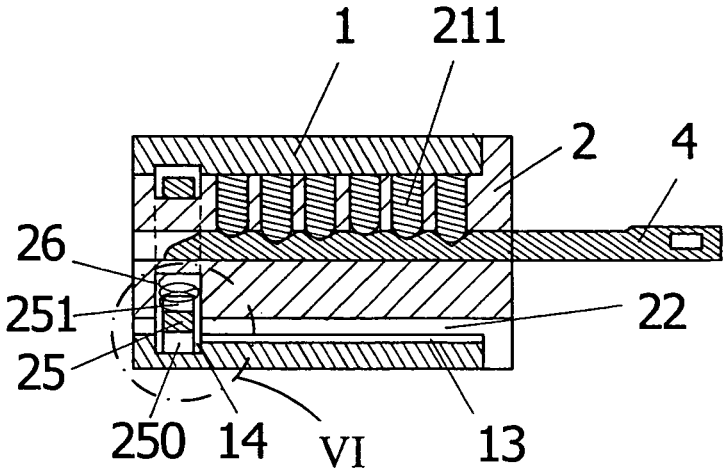
FIG. 5 is a sectional view of the lock in FIG. 1 after a key is inserted.
Figure 6:
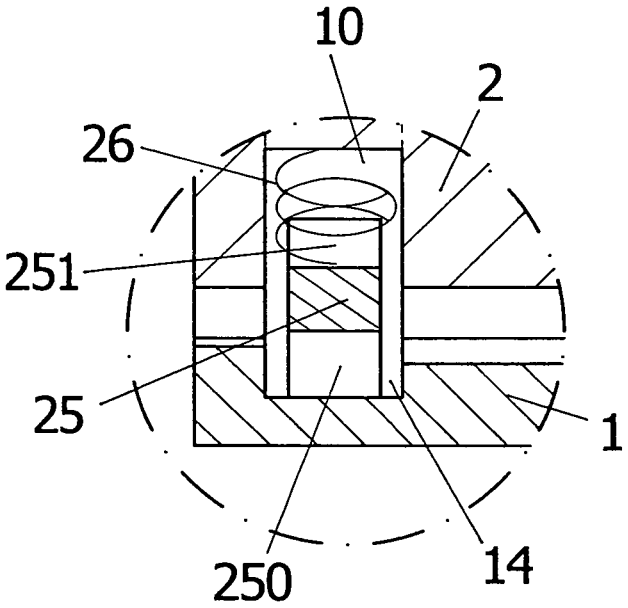
FIG. 6 is an enlarged view of the invention of part VI in FIG. 5.

Please refer to FIG. 4. One end of compression rod 3 is a compression rod sloping face 31. Compression rod 3 is inserted in the space created by the matching of the center through hole longitudinal groove 13 and core longitudinal groove 22, allowing compression rod 3 to push up the part of the fitting ring 25 that is clipped into the center through hole engagement groove. Thus, the best thickness for compression rod 3 is less than the total combined depth of center though hole longitudinal groove 13 and core longitudinal groove 22.

When installing the lock press down the fitting ring 25 and core 2 can be easily inserted into housing 1, making the installation of the aforementioned lock relatively convenient. Please refer to FIGS. 5 and 6. Under normal circumstances core 2 is fitted inside the center through hole 10 of the housing 1 and the fitting ring 25 is pushed by first spring 26 and clips into the center through hole engagement groove 14 of the center through hole 10. Core 2 is thus fixed in and can rotate inside center through hole 10, meaning that core 2 can rotate in center through hole 10 and will not become detached from housing 1. Fitting ring 25 clips into center through hole engagement groove 14 and core engagement groove 23, with the result that it will not easily become detached and fall off after long-term use, thus the use of the aforementioned lock will not be affected.

Figure 7:
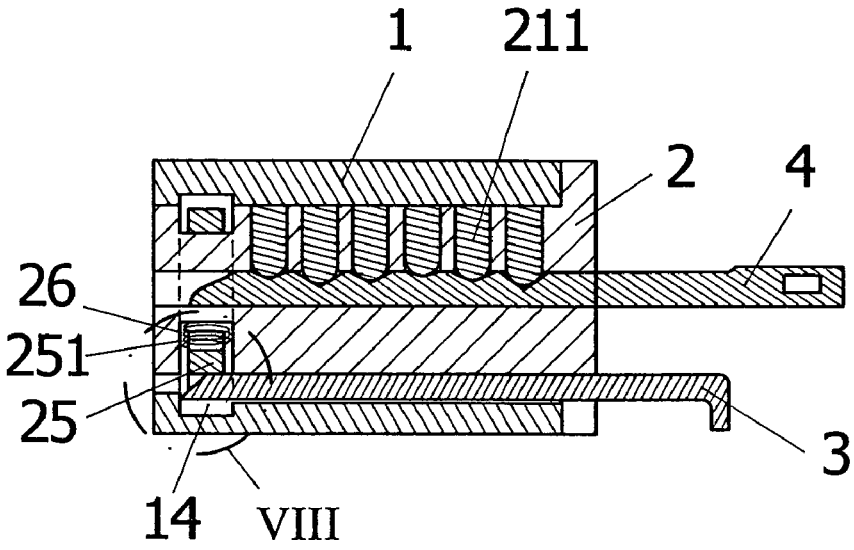
FIG. 7 is a sectional view of the lock in FIG. 1 after the compression rod is inserted.
Figure 8:
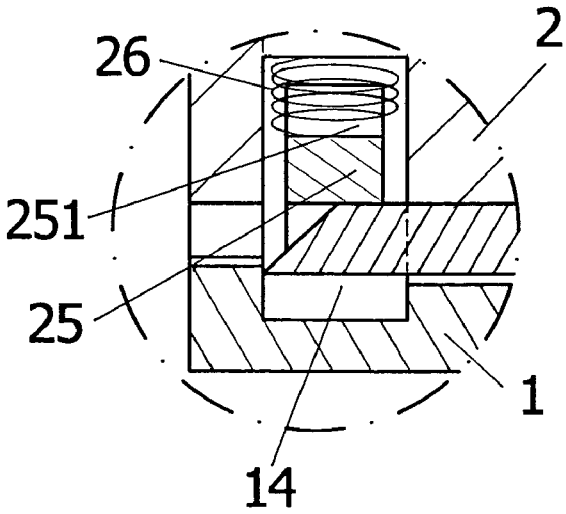
FIG. 8 is an enlarged view of the invention part VIII in FIG. 7.

Next, please refer to FIGS. 7 and 8. When you want to remove the core 2, first insert key 4 into the key hole 20 in core 2 and rotate core 2 to align core longitudinal groove 22 and center through hole longitudinal groove 13. Then, insert compression rod 3 into the space created by core longitudinal groove 22 and center through hole longitudinal groove 13 so that compression rod sloping face 31 pushes the bottom of recess 250. Fitting ring 25 will separate from center through hole engagement groove 14 when pushed by the sloping face 31 of the compression rod, disengaging the core 2 and the housing 1. This will allow the core 2 to be easily removed and the first tumbler pin 211 rearranged or changed, achieving the objective of conveniently changing first tumbler pin 211 and the key.

In addition, second tumbler pin 12 has a step member 121 which prevents it from being easily ejected when core 2 is removed. Furthermore, core 2 has a sloping face 24 at the core engagement groove 23 end and when the core 2 is placed inside the center through hole 10 again, second tumbler pin 12 and second spring 11 can be easily pushed into the inside wall of central through hole 10 using sloping face 24, allowing for convenient reassembly.

It can be understood that in the aforementioned lock, engagement groove 14 can be other shapes as well as annular, for example a step hole. Core engagement groove 23 can be other shapes as well as annular, for example, curved groove or curved with a flat bottom. Sloping face 24 can be another shape as well as conical slope, for example having a sloping bottom groove. In coordination with changes in the architecture of projection 251, first spring 26 can also be a different type of elastic part, for example a spring. The shape of the bottom of recess 250 can match the shape of compression rod sloping face 31 to allow force to be applied to fitting ring 25. In addition, it can be understood that the other end of compression rod 3 can be a shape that is freely chosen. When convenient removal of core 2 for rearranging or changing first tumbler pin 211 is not required, center through hole longitudinal groove 13 and core longitudinal groove 22 can be omitted.

The aforementioned description is only a preferred embodiment of the invention. Changes carried out by ordinary technicians in accordance with the main ideas and spirit of this invention, for example, changing the key hole groove, fitting ring, longitudinal groove or engagement groove shape or position should also be regarded as being within the scope of this invention and given protection.

While the preferred embodiment of the invention has been described above, it will be recognized and understood that various modifications may be made therein and the appended claims are intended to cover all such modifications that may fall within the spirit and scope of the invention.

What is claimed is:

1. A lock device, comprising:

a housing having a center through hole formed therein defining an inside wall of the housing, a center through hole engagement groove being disposed in the inside wall of the housing, a center through hole longitudinal groove being disposed in the inside wall and extending in a same direction as the center through hole, the center through hole longitudinal groove intersecting with the center through hole engagement groove;

a core which engages the center through hole of the housing, a core engagement groove being disposed on the core and corresponding to the center through hole engagement groove, a core longitudinal groove corresponding to the center through hole longitudinal groove of the housing, a key hole being formed in a middle portion of the core, a pin hole being formed in an outer surface of the core and extending radially therein such that the pin hole extends into the key hole, the outer surface of the core being tapered at a first end portion of the core adjacent the core engagement groove;

a fitting ring coupled to a first spring, the fitting ring and the first spring being positioned between the center through hole engagement groove and the core engagement groove such that the first spring is disposed in an inner portion of the core;

a first tumbler pin disposed in the pin hole of the core;

a step-shaped second tumbler pin coupled to a second spring, the second tumbler pin and the second spring being disposed on the inside wall of the housing;

a compression rod having a first end portion for inserting into the center hole longitudinal groove and the core longitudinal groove, the first end portion of the compression rod having a sloped face, wherein the combined depth of the center through hole longitudinal groove and the core longitudinal groove is larger than the thickness of the compression rod.

2. The lock device of claim 1, wherein a recess in disposed in a bottom portion of the fitting ring, a projection is disposed on the fitting ring opposite the recess, and the first spring is disposed on the projection.

3. The lock device of claim 1, wherein the core engagement groove is curved or curved with a flat bottom portion for securing the fitting ring.

* * * * *